United States Patent [19]

Davis et al.

[11] Patent Number: 4,561,861

[45] Date of Patent: Dec. 31, 1985

[54] MOTOR FUEL COMPOSITION

[75] Inventors: Marshall E. Davis, Poughkeepsie; Rodney L. Sung, Fishkill, both of N.Y.

[73] Assignee: Texaco Inc., White Plains, N.Y.

[21] Appl. No.: 667,048

[22] Filed: Nov. 1, 1984

[51] Int. Cl.[4] ..... C10L 1/32

[52] U.S. Cl. ..... 44/51; 44/53; 252/308; 252/312

[58] Field of Search ..... 44/53, 56, 77, 51; 123/1 A; 252/312, 308

[56] References Cited

U.S. PATENT DOCUMENTS

| | | | |
|---|---|---|---|
| 3,822,119 | 7/1974 | Frech | 44/56 |
| 3,876,391 | 4/1975 | McCoy et al. | 44/51 |
| 4,002,435 | 1/1977 | Wenzel et al. | 44/53 |
| 4,384,872 | 5/1983 | Kester et al. | 44/56 |
| 4,398,920 | 8/1983 | Guibet et al. | 44/56 |
| 4,445,908 | 5/1984 | Compere et al. | 44/56 |

*Primary Examiner*—William R. Dixon, Jr.
*Assistant Examiner*—Margaret B. Medley
*Attorney, Agent, or Firm*—Robert A. Kulason; James J. O'Loughlin; Albert Brent

[57] ABSTRACT

A clear stable motor fuel composition having an improved octane rating comprising alcohol selected from the group consisting of methanol in the amount of about 2.0 to 5.0 vol. %, ethanol in the amount of about 2.0 to 10.0 vol. %, and mixtures thereof in the amount of about 3 to 9.0 vol. %, about 2.0 to 10 vol. % of a cosolvent alcohol selected from the group consisting of tertiary butyl alcohol, isopropanol, and mixtures thereof; water to provide a total water concentration of about 0.1 to 0.5 wt. % (basis motor fuel composition); about 0.01 to 2.0 weight percent (basis motor fuel composition) of a nonionic surfactant represented by the formula alpha-hydro omega-hydroxy-poly (oxyethylene) poly (oxypropylene) poly (oxyethylene) block copolymer; and the balance comprising the base fuel gasoline.

12 Claims, No Drawings

MOTOR FUEL COMPOSITION

FIELD OF THE INVENTION

This invention relates to fuels for internal combustion engines and more particularly to a novel clear stable gasoline-alcohol-water motor fuel composition.

The use of aliphatic alcohols such as methanol and ethanol to extend gasoline fuels while imparting a higher octane rating to the gasoline has been long attempted. Alcohol-gasoline blends have a low tolerance for water that is encountered in the blending and distribution systems. Methanol-gasoline blends are much less water tolerant than ethanol-gasoline blends. Unstable hazy blends may result when water is present in such systems. Hazy gasolines are unacceptable by the public since they may indicate that something is wrong with the product. For example, the fuel may be contaminated. Further, phase separation may occur with water separating out and contributing to corrosion problems and motor starting difficulties.

On the other hand, it has been recognized that some water in the gasoline is desirable since the presence of water will reduce the Octane Requirement Increase (ORI), and will increase the Octane Rating (OR). Advantageously, by the subject invention gasoline may be extended and its performance improved by the addition of alcohols and water without producing haze and separation of the constituents.

U.S. Pat. No. 3,876,391 discloses clear motor fuel microemulsions comprising gasoline, water, two different surfactants and a water soluble and insufficiently gasoline soluble additive. No alcohol is present. U.S. Pat. No. 4,384,872 discloses a motor fuel composition comprising gasoline, alcohol and an interfacial modifying agent. No water is present.

SUMMARY OF THE INVENTION

In accordance with the invention there is provided a clear stable gasoline-alcohol-water motor fuel composition comprising a mixture of an alcohol selected from the group consisting of methanol in the amount of about 2.0 to 5.0 volume percent, ethanol in the amount of about 2.0 to 10.0 volume percent, and mixtures thereof in the amount of about 3.0 to 9.0 volume percent, about 2.0 to 10 volume percent of a cosolvent alcohol selected from the group consisting of tertiary butyl alcohol, isopropanol, and mixtures thereof; water to provide a total water concentration of about 0.1 to 0.5 weight percent; about 0.01 to 2.0 weight percent of surfactant which is represented by Formula I as follows:

$$HO(CH_2CH_2O)_a-(\underset{\underset{CH_3}{|}}{CH}-CH_2O)_b-(CH_2CH_2O)_cH \qquad \text{I}$$

where: a+c is an integer in the range of about 8.0–16.0, and b is an integer in the range of about 12–22; and the balance thereof being gasoline. Preferably, the volumetric ratio of teritary butyl alcohol and/or isopropanol to methanol and/or ethanol in the subject clear stable motor fuel composition is in the range of about 0.3 to 3.0, such as about 0.5 to 2.0.

This invention also provides a process for operating an internal combustion engine, supplying thereto, and combusting therein the above motor fuel composition.

DISCLOSURE OF THE INVENTION

The subject invention deals with clear stable motor fuel compositions comprising gasoline, at least two different alcohols, water and a surfactant. The surfactant more specifically comprises an alpha-hydro omega-hydroxy-poly(oxyethylene)poly(oxypropylene)-poly(oxyethylene) block copolymer. A low dosage e.g. about two weight percent or less of the surfactant will solubilize the water and form a microemulsion. The microemulsion is of the "water-in-petroleum" type in which the average particle diameter of the dispersed phase is about 0.1 micron or smaller. Clear stable gasoline-alcohol-water motor fuel compositions having upgraded performance characteristics are thereby provided.

The stable gasoline-alcohol-water motor fuel composition comprises a mixture of an alcohol selected from the group consisting of methanol in the amount of about 2.0 to 5.0 volume percent, ethanol in the amount of about 2.0 to 10.0 volume percent, and mixtures thereof in the amount of about 3.0 to 9.0 volume percent, about 2.0 to 10 volume percent of a cosolvent alcohol selected from the group consisting of tertiary butyl alcohol, isopropanol, and mixtures thereof; water to provide a total water concentration of about 0.1 to 0.5 weight percent (basis motor fuel composition), such as about 0.30 to 0.40 wt. %, about 0.01 to 2.0 weight percent such as about 0.02 to 0.50 wt. % say about 0.10 to 3.0 wt. % (basis motor fuel composition) of a surfactant represented by Formula I to be further described, and the remainder is a gasoline base fuel. Preferably, the volumetric ratio of tertiary butyl alcohol and/or isopropanol to methanol and/or ethanol in the subject clear stable motor fuel composition is in the range of about 0.3 to 3.0, such as about 0.5 to 2.0.

In one embodiment, the subject clear stable motor fuel composition may be prepared as follows:

Mixture A is prepared by mixing together an alcohol selected from the group consisting of methanol in the amount of about 2.0 to 5.0 vol. %, such as about 2.70 to 4.75 vol. %, ethanol in the amount of about 2.0 to 10.0 vol. %, such as about 4.75 to 9.0 vol. %, and mixtures thereof in the amount of about 3.0 to 9.0 vol. %; about 2 to 10 vol. %, such as about 4.75 to 6.3 vol. % of a cosolvent alcohol selected from the group consisting of tertiary butyl alcohol, isopropanol, and mixtures thereof; and water to provide a total water concentration of about 0.1 to 0.5 weight percent (basis motor fuel composition), such as about 0.30 to 0.40 wt. %. A hazy motor fuel composition is obtained when Mixture A and the base fuel gasoline, substantially comprising the remainder of the motor fuel composition, are mixed together. Further, about 0.01 to 2.0 weight percent (basis motor fuel composition) of a surfactant to be more fully described is added during the blending of Mixture A with the gasoline. Agitation is continued until the clear stable gasoline-alcohol-water motor fuel composition of this invention is made. The clear dispersion produced is a microemulsion.

The aforesaid improved surfactant which is used in the subject clear stable motor fuel composition comprises an alpha-hydro omega-hydroxy-poly(oxyethylene)poly(oxypropylene)poly(oxyethylene) block copolymer having the structural Formula I as follows:

$$HO(CH_2CH_2O)_a-(\underset{\underset{CH_3}{|}}{CH}-CH_2O)_b-(CH_2CH_2O)_cH \quad \text{I}$$

where: a+c is an integer in the range of about 8.0–16.0, such as about 11.9–15.9, and b is an integer in the range of about 12–22, such as about 18.1–21.1; and the balance comprising the base fuel gasoline. Preferably, the volumetric ratio of tertiary butyl alcohol and/or isopropanol to methanol and/or ethanol in the subject clear stable motor fuel composition is in the range of about 0.3 to 3.0, such as about 0.5 to 2.0. The molecular weight of said surfactant is in the range of about 1200 to 1750.

Any gasoline suitable for a spark-ignited internal combustion engine can be extended and its octane rating increased by being blended with water and a specific alcohol or mixture of alcohols in accordance with the practice of this invention. Clear stable gasoline-alcohol-water motor fuel compositions are thereby produced. In general, the base fuel will consist of a mixture of hydrocarbons in the gasoline boiling range i.e., boiling from about 75° to 450° F. The hydrocarbon components may consist of paraffinic naphthenic, aromatic and olefinic hydrocarbons. This gasoline can be obtained naturally or it may be produced by thermal or catalytic cracking and/or reforming of petroleum hydrocarbons. The base fuel will generally have a Research Octane Number above 85 and up to about 102 with the preferred range being from about 88 to 95. The clear stable gasoline-alcohol-water motor fuel composition of this invention will generally have a Research Octane Number above 90 and up to about 97, such as about 91 to 96.

In most cases, water from an external source will be introduced into the motor fuel composition to supplement any water that may be dissolved in the alcohol and/or gasoline. Sources of water include purified deionized water, and bottom phase water e.g. process water that sinks to the bottom of a gravity separation tank containing gasoline.

In another embodiment, gasoline contaminated with water may be processed into an upgraded clear stable motor fuel. In such case, the gasoline-water mixture is mixed with a mixture of the aforesaid alcohols, any additional water, and a surfactant having the previously described Formula I. The amount of each constituent is the same as that previously described in the preferred embodiment. Agitation is continued until a clear dispersion is produced.

Advantages of the present invention are illustrated by the following specific examples. These examples are set forth for purpose of illustration and should not be construed as limiting the invention.

EXAMPLE I

Clear stable gasoline-alcohol-water fuel Composition No. 1 was made by mixing together 50 parts by volume of clear unleaded gasoline (base fuel) and 50 parts by volume of clear gasoline with the addition of 4000 parts per million of water, 2.7 volume percent of methanol, and 6.3 volume percent of tertiary butyl alcohol to produce a hazy fuel composition. Surfactant compositions A to D (Formula I) as shown in Table I were then added dropwise at temperatures of 64° F. and 40° F. to said hazy fuel composition until the mixture was clear. The results of the fuel appearance are shown in Table II.

TABLE I

COMPOSITION OF FORMULA I SURFACTANTS

| Formula I Surfactants | Polyoxy-ethylene | Polyoxy-propylene | a + c | b | Molecular Weight |
|---|---|---|---|---|---|
| A | 30 wt. % | 70 wt. % | 8.2 | 14.5 | 1200 |
| B | 40 wt. % | 60 wt. % | 10.9 | 12.4 | 1200 |
| C | 30 wt. % | 70 wt. % | 11.9 | 21.1 | 1750 |
| D | 40 wt. % | 60 wt. % | 15.9 | 18.1 | 1750 |

TABLE II

FUEL APPEARANCE

| Temp. °F. | Fuel Composition No Surfactant | Amount of Surfactant to Produce Clear Stable Fuel Composition C | D | B |
|---|---|---|---|---|
| 64° | Hazy | 0.02 cc | 0.03 cc | 0.11 cc |
| 40° | Hazy | 0.26 cc | 0.07 cc | 0.16 cc |

EXAMPLE II 50 parts by volume of clear gasoline was mixed with 4000 parts per million of water, 2.7 volume % of methanol, and 6.3 volume % of tertiary butyl alcohol to produce Mixture 1. Clear unleaded base fuel e.g. gasoline called Mixture 2 was mixed with Mixture 1 in the volumetric proportions shown in Table II e.g. 10–50% Mixture 1 and the remainder Mixture 2 to produce a hazy Fuel Composition. Formula I surfactants A–D (see Table I in Example I) were added drop wise at 64° F., 40° F., and −4° F. until after the addition of the specified cubic centimeters of surfactant the hazy fuel composition became clear and the subject clear stable fuel composition was produced. The results are shown in Table III below:

TABLE III

| Surfactant | Mixture 1 | Mixture 2 | Amount of Surfactant to Produce Clear Stable Fuel Composition 64° F. | 40° F. | −4° F. |
|---|---|---|---|---|---|
| A | 10% | 90% | 0.12 cc | 0.35 cc | — |
| | 30% | 70% | 0.24 cc | 0.64 cc | — |
| | 50% | 50% | 0.22 cc | 0.65 cc | — |
| C | 10% | 90% | .05 cc | — | — |
| | 30% | 70% | 0.12 cc | 0.15 cc | — |
| | 50% | 50% | 0.02 cc | 0.26 cc | — |
| D | 10% | 90% | 0.06 cc | — | — |
| | 30% | 70% | 0.09 cc | 0.13 cc | 0.16 cc |
| | 50% | 50% | 0.03 cc | 0.07 cc | 0.37 cc |
| B | 10% | 90% | 0.05 cc | — | — |
| | 30% | 70% | 0.1 cc | — | 0.15 cc |
| | 50% | 50% | 0.11 cc | 0.16 cc | 0.19 cc |

Although this invention has been illustrated by reference to specific embodiments, it will be apparent to those skilled in the art that various changes and modifications may be made which clearly fall within the scope of this invention.

We claim:

1. A clear stable motor fuel composition of the "water-in-petroleum" type microemulsion in which the average particle diameter of the dispersed phase is about 0.1 micron or smaller, said motor fuel composition comprising a mixture of alcohol selected from the group consisting of methanol in the amount of about 2.0 to 5.0 vol. %, ethanol in the amount of about 2.0 to 10.0 vol. %, and mixtures thereof in the amount of about 3 to 9.0 vol. %; about 2.0 to 10 vol. % of a cosolvent alcohol selected from the group consisting of tertiary butyl alcohol, isopropanol, and mixtures thereof; water to provide a total water concentration of about 0.1 to 0.5 wt. %; about 0.01 to 2.0 wt. % of a nonionic surfactant represented by Formula I, as follows:

$$HO(CH_2CH_2O)_a-(\underset{\underset{CH_3}{|}}{CH}-CH_2O)_b-(CH_2CH_2O)_cH \quad \text{I}$$

where: a+c is an integer in the range of about 8.0–16.0, and b is an integer in the range of about 12–22; and the balance of said motor fuel composition comprising gasoline.

2. The motor fuel composition of claim 1 wherein the volumetric ratio of tertiary butyl alcohol and/or isopropanol to methanol and/or ethanol is in the range of about 0.30 to 3.0.

3. The motor fuel composition of claim 1 wherein the surfactant is present in the amount of about 0.10 to 3.0 weight percent of the total motor fuel composition.

4. The motor fuel composition of claim 1 wherein the water is about 0.30 to 0.40 weight percent of the total motor fuel composition.

5. The motor fuel composition of claim 1 where in structural Formula I a+c is an integer in the range of about 11.9 to 15.9, and b is an integer in the range of about 18.1 to 21.1.

6. A process for producing a clear stable motor fuel composition comprising mixture together the following ingredients to form a microemulsion of the "water-in-petroleum" type in which the average particle diameter of the dispersed phase is about 0.1 microns or smaller: an alcohol selected from the group consisting of methanol in the amount of about 2.0 to 5.0 vol. %, ethanol in the amount of about 2.0 to 10.0 vol. %, and mixtures thereof in the amount of about 3.0 to 9.0 vol. %; about 2.0–10 vol. % of a cosolvent alcohol selected from the group consisting of tertiary butyl alcohol, isopropanol, and mixtures thereof; water to provide a total water concentration of about 0.1 to 0.5 wt. %; about 0.10 to 3.0 of a nonionic surfactant having a molecular weight in the range of about 1200 to 1750 and which is represented by structural Formula I, as follows:

$$HO(CH_2CH_2O)_a-(\underset{\underset{CH_3}{|}}{CH}-CH_2O)_b-(CH_2CH_2O)_cH \quad \text{I}$$

where: a+c is an integer in the range of about 8.0–16.0, and b is an integer in the range of about 12–22; and the balance of said motor fuel composition comprising the base fuel gasoline.

7. The process of claim 6 wherein at least a portion of said water is provided dissolved in said gasoline and/or alcohol.

8. The process of claim 6 wherein the volume ratio of tertiary butyl alcohol and/or isopropanol to methanol and/or ethanol is in the range of about 0.3 to 3.0.

9. A process for producing upgraded clear stable motor fuel for an internal combustion engine from a hazy mixture of gasoline-alcohol-water said mixture comprising (i) an alcohol selected from the group consisting of methanol in the amount of about 2.0 to 5.0 vol. %, ethanol in the amount of about 2.0 to 10.0 vol. %, and mixtures thereof in the amount of about 3 to 9.0 vol. %; (ii) about 2.0 to 10 vol. % of a cosolvent alcohol selected from the group consisting of tertiary butyl alcohol, isopropanol, and mixtures thereof, wherein the volumetric ratio of tertiary butyl alcohol and/or isopropanol to methanol and/or ethanol is in the range of about 0.30 to 3.0; (iii) about 0.1 to 0.5 wt. % water; and (iv) the remainder of said mixture comprising gasoline; said process comprising mixing with said hazy gasoline-alcohol-water mixture to form a clear stable microemulsion of the water-in-petroleum type in which the average particle diameter of the dispersed phase is about 0.1 micron or smaller; about 0.10 to 3.0 wt. % of a nonionic surfactant having a molecular weight in the range of about 1200 to 1750 and which is represented by structural Formula I, as follows:

$$HO(CH_2CH_2O)_a-(\underset{\underset{CH_3}{|}}{CH}-CH_2O)_b-(CH_2CH_2O)_cH \quad \text{I}$$

where: a+c is an integer in the range of about 8.0–16.0, and b is an integer in the range of about 12–22.

10. The process of claim 9 wherein said upgraded clear stable motor fuel has a Research Octane Number in the range of above 90 and up to about 97.

11. A method for operating an internal combustion engine which comprises supplying thereto and combusting therein a clear stable gasoline-alcohol-water motor fuel composition of the "water-in-petroleum" type microemulsion in which the average particle diameter of the dispersed phase is about 0.1 micron or smaller, said motor fuel composition having a Research Octane Number in the range of above 85 and up to about 102 and comprising a mixture of alcohol selected from the group consisting of methanol in the amount of about 2.0 to 5.0 vol. %, ethanol in the amount of about 2.0 to 10.0 vol. %, and mixtures thereof in the amount of about 3 to 9.0 vol. %; about 2.0 to 10 vol. % of a cosolvent alcohol selected from the group consisting of tertiary butyl alcohol, isopropanol, and mixtures thereof, wherein the volumetric ratio of tertiary butyl alcohol and/or isopropanol to methanol and/or ethanol is in the range of about 0.30 to 3.0; water to provide a total water concentration of about 0.1 to 0.5 wt. %; and about 0.10 to 3.0 wt. % of a nonionic surfactant having a molecular weight in the range of about 1200 to 1750 and which is represented by structural Formula I, as follows:

$$HO(CH_2CH_2O)_a-(\underset{\underset{CH_3}{|}}{CH}-CH_2O)_b-(CH_2CH_2O)_cH \quad \text{I}$$

where: a+c is an integer in the range of about 8.0–16.0, and b is an integer in the range of about 12–22; and the remainder of said motor fuel composition comprising the base fuel gasoline.

12. The method of claim 9 wherein said internal combustion engine is spark-ignited.

* * * * *

UNITED STATES PATENT AND TRADEMARK OFFICE

CERTIFICATE OF CORRECTION

PATENT NO. : 4,561,861

DATED : 12/31/85

INVENTOR(S) : Marshall E. Davis & Rodney L. Sung

It is certified that error appears in the above—identified patent and that said Letters Patent is hereby corrected as shown below:

column 5, line 27, Replace "mixture" with --mixing--

Signed and Sealed this

*First* Day of *April 1986*

[SEAL]

*Attest:*

DONALD J. QUIGG

*Attesting Officer*

*Commissioner of Patents and Trademarks*